United States Patent [19]

Smith

[11] Patent Number: 4,516,482

[45] Date of Patent: May 14, 1985

[54] CONDITIONED AIR VESTIBULE FOR REFRIGERATED WAREHOUSE DOORWAY

[76] Inventor: George R. Smith, 21811 Georgia Ave., Brookeville, Md. 20792

[21] Appl. No.: 603,417

[22] Filed: Apr. 24, 1984

[51] Int. Cl.[3] ..... F24F 9/00

[52] U.S. Cl. ..... 98/36; 62/248; 62/255; 98/87; 98/31.6; 160/117; 160/332

[58] Field of Search ..... 98/36, 87, 90, 33 A; 62/248, 255, 256; 160/117, 332, 123

[56] References Cited

U.S. PATENT DOCUMENTS

| | | | |
|---|---|---|---|
| 2,827,266 | 3/1958 | Ruff | 98/36 |
| 3,023,688 | 3/1962 | Kramer, Jr. | 98/36 |
| 3,206,187 | 9/1965 | Cagley | 160/123 |
| 3,218,952 | 11/1965 | Gygax | 98/36 |
| 3,326,012 | 6/1967 | Asker et al. | 98/36 X |
| 3,664,254 | 5/1972 | Henson | 98/36 |
| 3,687,053 | 8/1972 | Henson et al. | 98/36 X |
| 3,817,160 | 6/1974 | Searcy et al. | 98/36 |
| 4,074,620 | 2/1978 | Jansson | 98/36 |
| 4,301,787 | 12/1981 | Rice | 126/429 |
| 4,304,174 | 12/1981 | Hickson et al. | 98/33 |
| 4,427,049 | 1/1984 | Belanger et al. | 160/199 |
| 4,432,406 | 2/1984 | Belanger et al. | 160/199 |

OTHER PUBLICATIONS

HCR Conditioned Air Curtain Bulletin, Industrial Air Conditioning Co., Falls Church, VA 22042 (undated).

NAWGA/IFDA Operations Bulletin, Aug. 1983, NAWGA/IFDA, 201 Park Washington Court, Falls Church, VA.

NAWGA/IFDA Operations Bulletin, Sep. 1983.

*Primary Examiner*—Harold Joyce

*Attorney, Agent, or Firm*—O'Neil & Bean

[57] ABSTRACT

An improved, low cost conditioned air vestibule for use on a doorway of a refrigerated storage room permits unobstructed passage of vehicles while effectively reducing the exchange of air through the doorway and substantially eliminating precipitation both inside and outside the doorway by providing spaced inner and outer movable doors in a portal and extending across the doorway to define a closed entrance vestibule, and circulating conditioned air through the vestibule. Heated air is directed downwardly from adjacent the top of the doorway through the vestibule along substantially its full width and adjacent the surface of the inner or cold side door and air is withdrawn from the vestibule at the top of the doorway adjacent the outer or warm side door. The doors are spaced close together and actuators are provided for opening and closing both doors simultaneously to permit unobstructed passage of vehicles. Preferably, the doors are transparent strip doors permitting unobstructed vision through the vestibule while permitting passage through the doorway without opening the doors.

15 Claims, 6 Drawing Figures

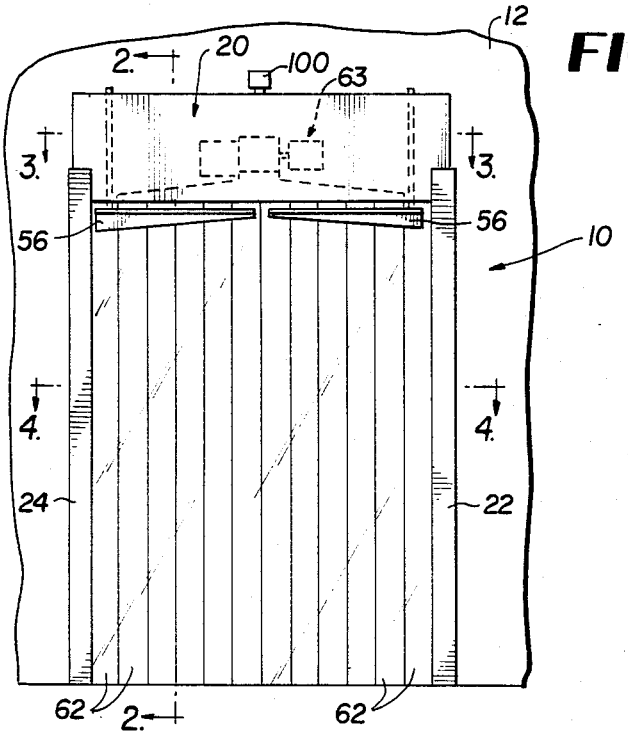
FIG.1
FIG.2
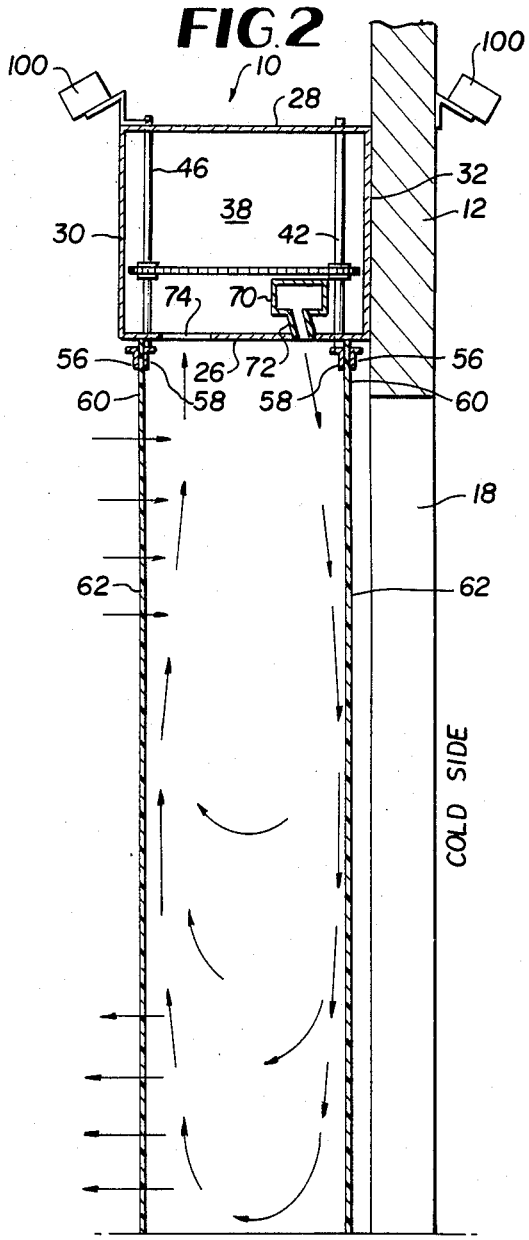
FIG.4
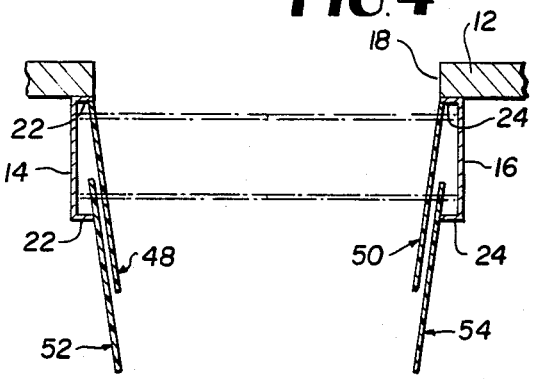
FIG.3
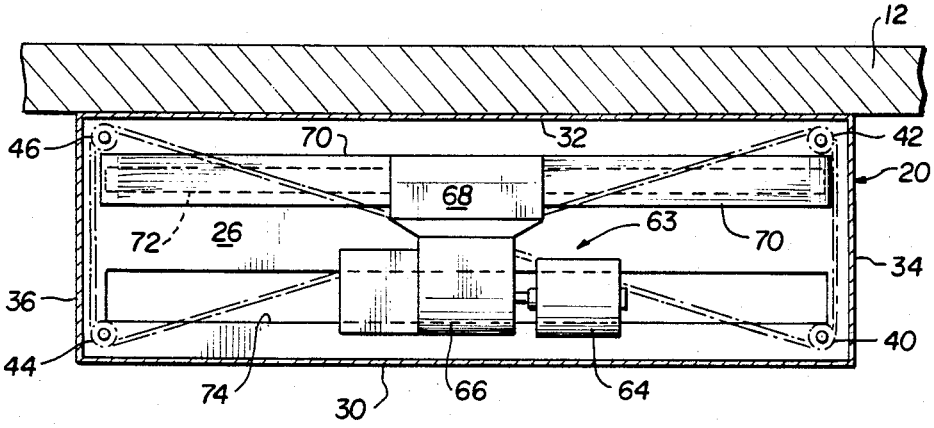

PR. SOURCE
102
104
106
44
92
94
46
96
98
36
88
86
26
64
66
70
16
78
68
30
56
40
42
24
76
58
24
82
32
54
34
84
62
22
14

SATURATION LINE 100% R.H.
80% R.H.
60% R.H.
40%R.H.
20% R.H.
SUPERSATURATED AIR
LOADING DOCK
A
C
108
110
FREEZER
B
-20 -10 0 10 20 30 40 50 60 70 80 90 100
DRY BULB TEMP (°F)
10 20 30 40 50 60 70 80 90 100 110 120
MOISTURE (GRAINS/LB DRY AIR)

CONDITIONED AIR VESTIBULE FOR REFRIGERATED WAREHOUSE DOORWAY

BACKGROUND OF THE INVENTION

1. Field of the Invention

This invention relates to devices for controlling the exchange of air through doorways to refrigerated spaces, and more particularly to an improved conditioned air vestibule for use at a doorway of a refrigerated storage room.

2. Description of the Prior Art

The recent rapid growth in the demand for frozen or refrigerated goods, particularly refrigerated or frozen foods, has resulted in a corresponding increase in both the number and use of refrigerated storage or warehouse facilities sometimes referred to herein as cold storage rooms. Doors provide access to such cold storage rooms from loading docks or other adjacent spaces for material handling vehicles and pedestrian traffic. Traffic through the doors is frequently heavy particularly at peak periods of the day so that the doorways are necessarily open at least a substantial portion of the time and many are kept open continuously during such peak traffic periods. Such open doorways present problems both with regard to operation and maintenance of refrigeration equipment and with regard to the productivity and safety of the facility.

As is recognized, an open doorway to a refrigerated space permits the heavier refrigerated air to flow out of the refrigerated space through the lower half of the opening and an equal mass of warm humid air to flow inward through the upper half. In this air exchange, warm air entering the refrigerated space is referred to in the industry as infiltration air, and cold air escaping is sometimes referred to as exfiltration air.

When a warm air mass encounters a cold air mass, precipitation commonly occurs, the eventuality of this phenomenon depending upon conditions of the two air masses relative to one another. The form of precipitation, i.e., water droplets or airborn ice crystals, depends upon the temperature of the mixture.

The warm and cold side conditions at the entrance to subfreezing cold storage rooms or freezer rooms are generally in the precipitation range relative to each other, at least during mild and warmer weather, and almost always in the warmer climates. As warm air enters through the top of a freezer room door, precipitation in the form of airborn ice crystals is visible as haze while visible fog frequently appears outside the door as cold air escapes from the bottom of the door and mixes with the warm humid outside air. Warm side fog can obstruct the vision of personnel, including vehicle operators, working in the area. In addition, the chilled fog-laden air frequently causes wet slippery floors in the vicinity of the doorway with consequent hazards not only to personnel but also to equipment and material.

Precipitation from infiltration air is generally found to be even more objectionable than fog outside the door. The airborn ice crystals result in frost or snow accumulation on ceilings, walls, and freezer room appurtenances as well as on products stored in the room. Such frost frequently grows to many inches in thickness and can result in snow droppings which cause icy floors and present extremely slippery and hazardous conditions for forklift trucks. Further, the airborn ice crystals may be drawn into the refrigeration equipment and produce premature clogging of the coils, as compared with normal evaporator coil icing, thereby reducing the refrigeration effect and adding coil defrosting burden. The result is a substantial reduction in refrigeration efficiency and may require installation of additional evaporator coils or oversized refrigeration equipment.

Many attempts have been made to reduce the air exchange at open refrigerated warehouse doors. One common approach has been to employ an air curtain across the door, with the forced flow of relatively high velocity air across the opening serving both to restrict the normal air exchange resulting from the temperature differential and to mix or dilute any air which does pass through the air curtain with the high velocity airstream to reduce the precipitation rate. Examples of such devices may be found, for example, in U.S. Pat. Nos. 3,218,952 and 3,817,160.

It is also known to condition air used in such air doors by heating the air employed in the air curtain to reduce precipitation both inside and outside the refrigerated space. Air curtain apparatus employing conditioned air for use in connection with refrigerated warehouse doors has been marketed by Industrial Air Conditioning Company of Falls Church, Virginia under the trademark HCR.

A relatively short conditioned air vestibule having two spaced air curtain doors employing conditioned air in the air curtain has also been marketed by Industrial Air Conditioning Corporation, and one such device is illustrated in U.S. Pat. No. Des. 140,200. Such devices, while effective in substantially eliminating precipitation both inside and outside a refrigerated warehouse door, are relatively expensive to install and operate and occupy more floor space than the conditioned air vestibule of the present invention.

Physical barriers, particularly the well known strip doors, are also widely used to restrict the flow of air through an open refrigerated warehouse door. Such strip doors employ transparent vinyl strips which enable personnel and vehicles to push through, with the strips quickly falling back into place to act as an air flow barrier when the obstruction has cleared the door.

Another known system for controlling precipitation from infiltration or exfiltration air employs a step-down room at the door, with the step-down room having a physical barrier such as a strip door or rigid push-through door at each end for restricting air exchange. The air inside such step-down rooms is heated to a non-fogging or non-frost producing level and to prevent airborn crystal formation in the refrigerated room as a result of air infiltration. This level of heat is normally found sufficient to prevent fog formation as a result of air exfiltration from the step-down room. The known step-down rooms are of sufficient size to permit material handling vehicles to enter one end and the door to close behind it before reaching and pushing through the door at the other end. Such arrangements are therefore costly both because they occupy substantial floor space and because of the relatively large volume of heated air required.

Large step-down rooms also have generally been considered objectionable in that their tunnel configuration tends to restrict the vision of forklift operators and therefore can present a safety hazard. For this reason, it has been common practice to provide two step-down rooms to enable one way traffic entering and leaving the cold storage room.

The use of push through strip doors is also objectionable in that the strips tend to become less transparent with use and may present an obstruction to vision. Further, frost or fog condensation on the strip surfaces not only obstruct vision, but the wet, cold surfaces are generally considered objectionable by personnel passing through the door. The relatively heavy plastic strips can also drag lightweight items such as empty cartons from material handling equipment.

SUMMARY OF THE INVENTION

It is a primary object of the present invention to provide a relatively inexpensive, efficient and effective conditioned air vestibule which is operable to control air exchange through a cold storage room door and which overcomes many of the defects of the prior art apparatus.

Another object is to provide such a conditioned air vestibule which may be installed on either the warm side or the cold side of existing cold storage room doors and which is operable to greatly reduce the flow of infiltration air into and exfiltration air out of cold rooms.

Another object is to provide such a conditioned air vestibule which occupies a minimum of floor space and which may safely be used for two way traffic through the cold storage room door.

Another object is to provide such a conditioned air vestibule including means for conditioning air within the vestibule so that any air flow through the vestibule will not result in precipitation.

Another object is to provide such a conditioned air vestibule which is effective in maintaining all see-through and other surfaces of the vestibule clear of frost and moisture.

Another object is to provide such a conditioned air vestibule which is economical to manufacture and operate and which requires a minimum of maintenance.

The foregoing and other objects and advantages of the invention are achieved in a conditioned air vestibule employing a rigid frame defining a short tunnel or portal at a cold storage room door and a pair of spaced, movable doors extending across the portal to define a closed space or vestibule. The two doors thus provide a double barrier protecting against air exchange. An air conditioning and circulating apparatus is provided to direct a thin, non-turbulent jet of heated air downwardly from the top of the doorway through the vestibule along the surface of the inner or cold side door substantially across its full width and for withdrawing air from the other side of the vestibule adjacent the top of the outer or warm side door, again substantially across the full width of the door. The heated air flowing over the surface of the doors prevents formation of frost on the cold side door and condensation or moisture on the warm side door to maintain any see-through surfaces in a clear condition. The temperature in the vestibule is maintained at a level such that any infiltration air does not pass through the saturation level when entering the cold storage room and therefore does not produce precipitation. Similarly, any exfiltration air escaping the vestibule and mixing with the warm outside air does not produce fog.

The doors employed to define the vestibule preferably are strip doors and are mounted for automatic actuation in response to a motion sensor or other suitable control device to simultaneously open both doors, for example into parallel overlapping relation, to permit personnel and equipment to pass unobstructed and to immediately return the doors to the closed condition forming the conditioned air vestibule when the vestibule is clear of obstruction. By employing lightweight vinyl strip doors, fast acting actuators may be employed so that the doors are open only for a relatively short time. Opening the doors for traffic and keeping condensation off the strips as a result of the conditioned air inside the vestibule enables substantially unobstructed vision through the vestibule at all times.

An important feature of the conditioned air vestibule of the present invention is its shallow depth in the direction of movement of traffic through the apparatus. This depth is maintained such that both doors must be opened substantially simultaneously to permit traffic through the apparatus. The shallow depth, or relatively close spacing of the two doors enables a thin coherent stream of air discharged at the top of the vestibule to flow downward along the surface of the cold side door to the floor then be drawn up along the warm side door to condition the air throughout the vestibule without requiring excessive inlet air velocity and the consequent excessive elevation of pressure in the vestibule. Air in the relatively small conditioned air vestibule defined by the relatively closely spaced doors can easily be maintained at a temperature level where supersaturation is avoided upon passage of infiltration air through the doorway, thereby completely avoiding precipitation in the cold storage room when the vestibule doors are closed.

BRIEF DESCRIPTION OF THE DRAWINGS

Other features and advantages of the invention will be apparent from the detailed description contained hereinbelow, taken in conjunction with the drawings, in which:

FIG. 1 is an elevation view of a conditioned air vestibule according to the present invention installed on a doorway of a cold storage room;

FIG. 2 is an enlarged sectional view taken along line 2—2 of FIG. 1;

FIG. 3 is an enlarged sectional view taken along line 3—3 of FIG. 1;

FIG. 4 is a sectional view taken along line 4—4 of FIG. 1;

DESCRIPTION OF THE PREFERRED EMBODIMENT

Figure 5:
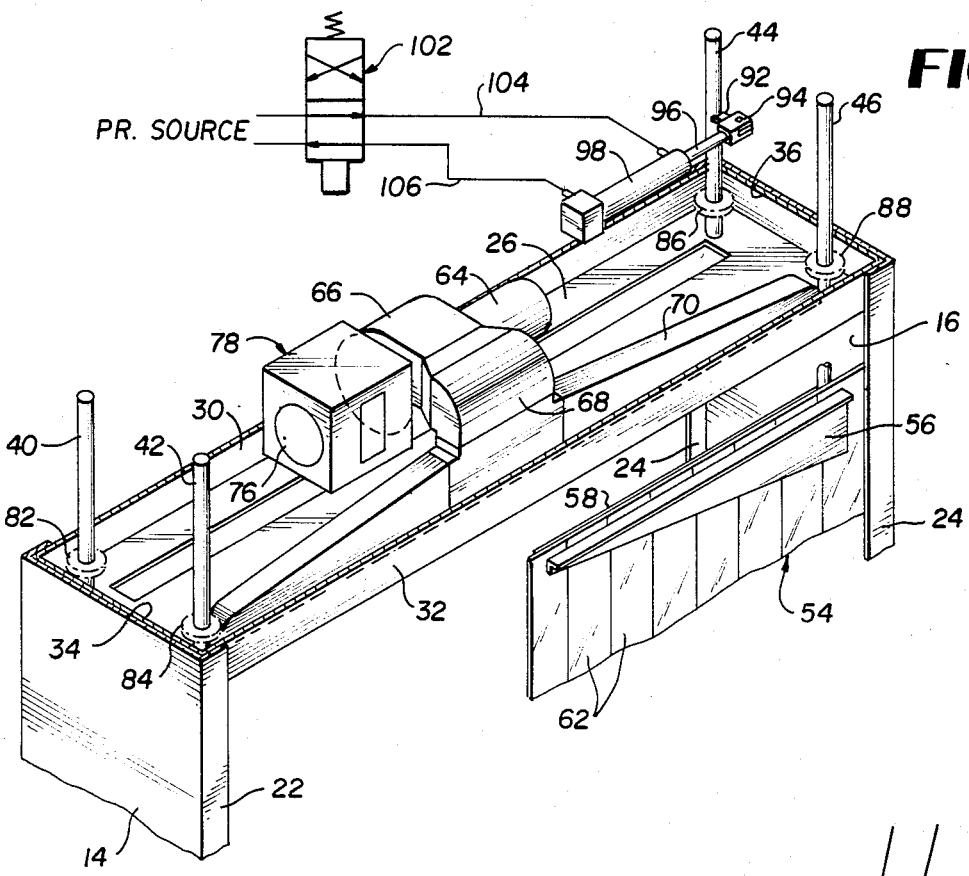
FIG. 5 is a fragmentary isometric view of a portion of the structure shown in FIGS. 1-4.

Referring now to the drawings in detail, a conditioned air vestibule assembly incorporating the present invention is designated generally by the reference numeral 10 and is illustrated in elevation view in FIG. 1 as mounted on the external or warm side of a door opening in the wall 12 of a refrigerated warehouse. The assembly 10 comprises a rigid frame including a pair of vertically extending parallel jambs or side panels 14, 16 adapted to be mounted one adjacent the side edge portion of a door opening 18 in the warehouse wall 12. A generally rectangular closed housing 20 is joined to and supported on the top end portions of side panels 14, 16 which extend above the door opening 18. As best seen in FIGS. 4 and 5, side panel 14 has inwardly directed flanges 22 extending along its side edges and panel 16 has corresponding flanges 24 extending along its side edge portions. Flanges 22 and 24 provide strength and rigidity to the panels for supporting housing 20 and serve as a convenient means for mounting the frame to wall 12. If desired, the side panels may also be reinforced with suitable means such as structural angles extending along and rigidly joined to their corner portions.

Housing 20 is an elongated box-like structure including a bottom wall 26, a top wall 28, side walls 30, 32, and end walls 34, 36 cooperating to define an enclosed space 38. Four vertically extending shafts 40, 42, 44 and 46, respectively are mounted within the corner portions of housing 20, with each shaft having its lower end portion extending through and projecting below bottom wall 26. Suitable bearings, not shown, are provided to journal the top and bottom portions of the respective shafts for rotation in openings in the top and bottom walls, respectively, of the housing. Shafts 40, 42, 44, and 46, respectively, each have a strip door assembly 48, 50, 52, 54, respectively, rigidly mounted on their downwardly projecting end portions for rotation therewith between the closed position shown in broken lines and the open positions shown in full lines in FIG. 4. For clarity, only strip door assembly 54 is shown in FIG. 5, it being understood that all the strip doors are substantially identical.

Door assembly 54 includes a cantilevered beam assembly made up of a pair of angle members 56, 58 extending in a parallel opposed relation, with the inner angle 58, having one end rigidly attached as by welding to the downwardly projecting end portion of the shaft 46, as indicated at 60 in FIG. 2. Angle member 56 may be releasably but rigidly attached to angle member 58 by screw fasteners or the like to firmly clamp the top end portions of the flexible transparent vinyl strips 62 of the strip door. Preferably strips 62 are supported in overlapping relation, with the strips hanging vertically downward to form a barrier to airflow in the manner known in the art. The top portion of the vinyl strips 62 may project upwardly above the top of the joined angles 56, 58 to engage and form a seal with the bottom surface of wall 26 of housing 20 when the doors are in the closed position.

As best seen in FIGS. 3 and 5, an air circulating and heating apparatus, indicated generally by the reference numeral 63, is supported within housing 20. Air circulation apparatus 63 includes a motor 64 connected to a blower 66 having its discharge outlet 68 disposed centrally between end panels 34 and 36. Outlet 68 is connected to an elongated tapered air duct 70 which extends substantially the full length of housing 20 in parallel spaced relation to the wall 32, with the outlet 68 being connected at approximately the center of duct 70. Suitable baffles, not shown, may be mounted in the duct 70 to direct airflow from the blower 66 laterally along the length of the duct. An elongated outlet nozzle 72 extends through bottom wall 26 and communicates with the duct 70 for discharging air downwardly through the vestibule defined by jambs 14 and 16 and by the spaced barrier walls defined by closed doors 48 and 50 and by closed doors 52 and 54. Suitable guides vanes, not shown, may be employed in nozzle 72 to direct air from the nozzle downward in a uniform coherent stream along substantially the full width of the vestibule.

Air is drawn by blower 66 from the vestibule through an elongated inlet opening 74 in wall 26 into housing 20. Opening 74 extends substantially the full length of housing 20 in inwardly spaced parallel relation to wall 30. The air is drawn from the interior of the housing 20 through an opening 76 in a heater assembly 78 mounted within the housing.

Heater 78 may be of any suitable design having the capacity to heat air drawn into the blower to the desired temperature. Preferably, however, heater 78 includes a plurality of independently energized electrical resistance heater elements disposed in the path of the air drawn into the blower, with the heater elements being connected in circuits such that all or any desired portion of the elements may be energized as necessary to control the temperature of the air discharged from the blower 66. As best seen in FIG. 2, operation of the blower and heater element directs heated, or conditioned, air downwardly along the surface of door assemblies 48, 50 with the nozzle 72 being angled to direct the air stream slightly toward the doors so that the heated air warms the door surfaces to prevent the formation of frost or condensation on the transparent plastic strips 62 and thereby assure good visibility through the doors.

Since air is discharged from nozzle 72 in an elongated narrow, coherent stream along substantially the full width of the vestibule, the air flows downwardly along the surface of door assemblies 48 and 50, then upwardly along the inner surfaces of outer door assemblies 54 and 54 to warm the entire vestibule and to prevent condensation forming on any door surfaces. The temperature of the air circulating in the vestibule is, of course, highest adjacent the top portion of the cold side door assemblies, i.e., the door assemblies on the side closest the refrigerated room, and warmest adjacent the top portion of the warm side door assemblies. Since infiltration air enters through the top portion of a door opening, any such infiltration air from the vestibule will be from the location of maximum temperature in the vestibule. Similarly, exfiltration air escaping from the bottom half of the door opening will be mixed with and be warmed by air in the bottom portion of the vestibule so that any such air reaching the outside will not produce fog.

To move the strip doors between the open and closed positions, sprockets 82, 84, 86 and 88, respectively, are mounted on shafts 40, 42, 44 and 46, respectively, for rotation therewith and a chain 90 extends around the four sprockets. The chain 90 crosses itself in the center portion of chamber 20 so that movement of the chain will simultaneously rotate all of the sprockets with sprockets 82 and 84 rotating in a direction opposite to that of sprockets 86 and 88. If necessary, suitable guide means may be provided to prevent chain 90 from engaging itself at the point of crossing.

An actuating lever 92 has one end rigidly connected to shaft 44 and its other end pivotly connected as at 94 to the rod 96 of a double acting fluid actuator assembly 98. Actuator 98 has its cylinder end pivotly connected to a suitable bracket, not shown, in housing 20 so that extending and retracting rod 96 will rotate shaft 44. Since all of the door supporting shafts are connected for simultaneous rotation, a single power actuator 98, typically an air cylinder, may be employed to swing all of the door assemblies between the open and closed positions.

To control movement of the door assemblies between the closed, vestibule-forming position shown in broken lines and the open position shown in full lines in FIG. 4, a suitable sensing device such as a motion sensor 100 may be mounted above the vestibule in position to sense personnel or equipment approaching from either side. Motion sensors 100 may be of a conventional design such as employed to actuate doors in airports, stores and the like. Alternatively, of course, other sensors such as photoelectric sensors or pressure switches may be employed to control actuation of the door assemblies.

Sensors 100 are connected in a conventional control circuit, not shown, to control the flow of pressure fluid from a suitable source through a solenoid actuated, two-position, four-way control valve 102 to control the flow of pressure fluid through conduits 104 and 106 to the rod and cylinder ends, respectively, of actuator assembly 98. As a safety measure, actuator 98 may incorporate resilient spring means continuously urging the door assemblies to the closed positions so that, in the event of power failure or malfunction of the system, the doors will be automatically maintained in the closed position.

In the open position, door assemblies 48 and 52 extend in a closely spaced, substantially parallel overlapping relation at one side of the entrance to the cold storage room while panels 50 and 54 extend in similar relation at the other side of the entrance. In this position, vehicles such as forklift trucks may pass freely through the doorway. By using transparent strip panels which are maintained free of condensation or frosting by the present invention, and by employing a vestibule assembly which defines a relatively short portal or tunnel at the entrance, substantially unobstructed vision is provided for vehicle operators passing through the doorway.

A conditioned air vestibule according to the present invention has been installed on a freezer room doorway six feet wide and eight feet high. In this installation, the strip door panels on the cold and warm side of the vestibule are approximately 20 inches apart. Testing has shown this short tunnel configuration to be surprisingly efficient in reducing air exchange at the freezer room door. At the same time, the small volume of the vestibule enables a correspondingly small volume of air to be circulated in a reverse path across the vestibule and back through the air heating system. Testing has also shown that precipitation can be completely eliminated on both sides of the freezer room door and the transparent vinyl strips maintained in a condensation-free condition at a 90% to 95% net energy saving compared to energy loss through an open door of the same size. At the same time, problems associated with precipitation were substantially eliminated.

It is desirable to maintain the spacing between the cold side and warm side doors as close as possible not only to conserve critical space at the door of a cold storage room but also to reduce the volume of air in the vestibule and consequently the energy required to heat and to circulate the air throughout the vestibule. There are some practical limits on this minimum spacing, however, since positioning the doors too close together will restrict the desired air circulation along the door surfaces from top to bottom of the vestibule. When the doors are too close, an increased air velocity is required at the nozzle 72 to assure that adequate heated air reaches the bottom portion of the vestibule. This not only increases the energy required to circulate the air, but also results in a build-up of static pressure within the vestibule and a consequent forcing of air through the strip doors on both the warm and cold side of the vestibule.

The minimum spacing between the warm and cold side doors will depend to some extent on the height of the doorway which determines the vertical distance which the circulating air must travel. As a practical matter, however, the height of doors in commercial cold storage warehouses is related to the door width and not so great as to require excessive spacing of the vestibule doors. Thus, in practice, it has been found that the maximum opening of the vestibule doors normally will be no greater than about one half the width of the door opening for relatively narrow doors such as used primarily for pedestrain traffic and preferably no greater than about one fourth the door width for wider doors used for vehicular traffic. By maintaining this spacing and actuating the warm and cold side doors simultaneously, the advantages of a single automatic strip door or an open door are achieved in so far as space, visibility and safety are concerned. At the same time, the conditioned air within the vestibule provides an economical and effective means of eliminating precipitation from infiltration and exfiltration air when the doors are closed.

As discussed above, when warm and cold air masses encounter one another, precipitation may occur depending upon the relative humidity and the temperature differential of the two masses. Precipitation commences when the relative humidity of the resulting mixture reaches the supersaturation point and whether the precipitation is in the form of minute airborn water droplets (fog) or ice crystals (haze) depends upon the temperature of the mixture.

The warm and cold side conditions at the entrance to subfreezing cold rooms are normally in the precipitation producing range during warm weather so that, when warm outside air enters the freezing room and is chilled by mixture with the cold inside air, the relative humidity of the mixture passes into the supersaturation range and precipitation commences. A similar condition exists on the warm side as subfreezing air flows out the bottom of the door opening and chills the warm humid outside air to produce fog. Regardless of the temperature differential, however, precipitation does not occur when the relative humidity of the resulting air mixture, whether inside or outside the freezing room, remains below the supersaturation level.

Figure 6:
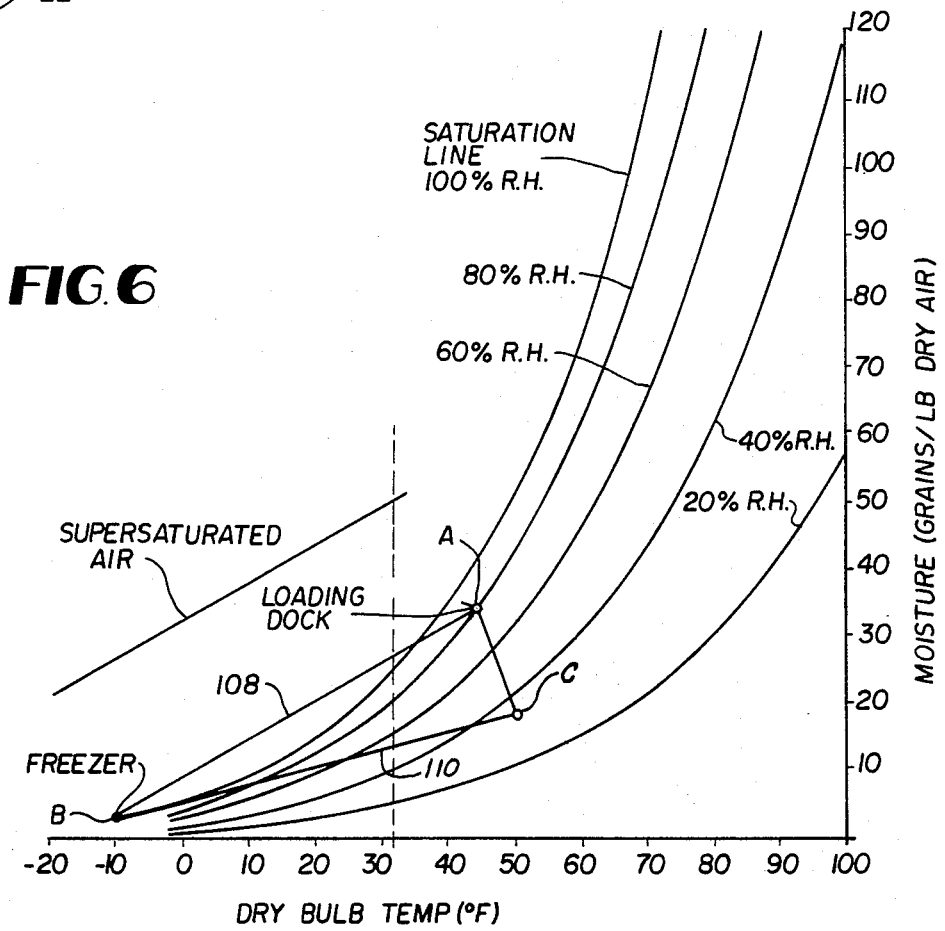
FIG. 6 is a psychrometric chart illustrating operation of the invention to avoid precipitation as a result of air infiltration and exfiltration through the conditioned air vestibule.

Referring to the psychrometric chart of FIG. 6, conditions at the entrance of a freezer room are depicted. In this illustration, the temperature inside the freezing room is maintained at −10° F., with the outside temperature and relative humidity varying depending upon weather conditions. Assuming an outside air temperature of 45° F. and relative humidity of 80% as shown at point A on the psychrometric chart, infiltration air entering the freezer room and encountering the cold air will be chilled along process line 108 from the conditions at point A to the inside conditions at point B. As is seen, process line 108 passes through the 100% relative humidity level at about 35° F. so that precipitation in the form of fog will commence at this point. As the temperature drops below the freezing level, the precipitation changes from fog to airborn ice crystals which ultimately accumulate as frost or snow on ceilings, walls and the like and result in snow droppings on the floor which create hazardous icy conditions. The airborn ice crystals are also drawn into the condenser coils of the refrigeration equipment and accumulates as thick frost coatings which greatly reduce the efficiency of the equipment.

In accordance with the present invention, precipitation is avoided by conditioning the air inside the vestibule so that it does not pass into the supersaturation condition upon infiltrating into the freezer room. This is accomplished by heating the air circulated through the vestibule to change the conditions in the vestibule to those represented at point C on the psychrometric chart of FIG. 6. From this position, i.e., approximately 51° F. and 34% relative humidity, it is seen that the process line 110 followed by air being chilled from point C to point B will pass just tangent to the 100% humidity line on the psychrometric chart. Thus, since the infiltration air never passes into the supersaturated condition, no precipitation will occur inside the freezer room. The addition of heat to the air in the vestibule also raises the temperature of the exfiltration air to such a level that fogging is avoided outside the freezer room.

In accordance with the present invention, advantages of the prior art step down rooms or conditioned air vestibules are combined with advantages of physical barriers which limit the normal open-door air exchange. This is accomplished by the inexpensive, relatively maintenance-free apparatus described above. By providing an air heater system capable of supplying various quantities of heat to the air being circulated within the vestibule, it is only necessary to supply the amount of heat required to avoid precipitation in the freezer for a range of ambient or outside conditions. If haze becomes evident in the cold storage room, more heat can be added until the air again becomes clear.

By supporting the strip doors for automatic opening and closing, the advantages of an open doorway are achieved in so far as providing unobstructed passage for personnel and equipment moving into and out of the freezer space. At the same time, the closed doors provide a double physical barrier to infiltration and exfiltration of air through the door. Thus, the conditioned air vestibule of this invention greatly reduces infiltration air and moves the psychrometric process of the remaining air from its supersaturated path to completely avoid precipitation in the freezer room when the vestibule doors are closed. The use of a relatively lightweight door such as the vinyl strip doors described enables fast acting actuators to be employed to automatically open and close the doors for the passage of equipment so that the time during which the doors are open is maintained at a minimum. While other door construction may be employed, the strip doors described are preferred not only because of the see-through feature of such doors but also because of their reduced air resistance during opening and closing.

It should be pointed out that a separate actuator could be provided for each door or that one actuator could be employed to open and close the two doors on each side of the wall opening. Also, various arrangements may be employed to connect the shafts for simultaneous rotation. For example, a reversible rotary motor might be employed to engage and directly drive the chain 90 to open and close the doors, or an articulated linkage might be employed in place of the chain 90. It should also be apparent that only a single door panel may be required on the cold and warm sides, respectively, of the vestibule and this arrangement may be preferred for relatively narrow doors. Also, bi-fold strip doors of the general type illustrated, for example, in U.S. Pat. No. 4,432,406 might be employed instead of the swinging doors illustrated.

While preferred embodiments of the invention have been disclosed and described, it should be apparent that various modifications might be made without departing from the invention and it is therefore intended to include all embodiments of the invention which would be apparent to one skilled in the art and which come within the spirit and scope of the invention.

What is claimed is:

1. A conditioned air vestibule for controlling the flow of air through a door opening in a wall of a cold storage room and for reducing precipitation resulting from such air flow, said apparatus comprising, a frame including a pair of laterally spaced vertically extending side panels and a top panel, said frame being adapted to be mounted in contact with the refrigerated room wall in surrounding relation to the door opening with said side panels extending outwardly from the wall one adjacent each side of the door opening, said side and top panels cooperating to define an open portal projecting from the wall, first and second door panel means, mounting means supporting said first and said second door panel means for movement between a closed position extending across and closing said portal and an open position, said first and said second door panel means in the closed position being disposed in parallel planes spaced from one another in the direction of travel through the door opening a distance no greater than about one half the distance between said side panels and cooperating with said frame to define a closed vestibule, power means for substantially simultaneously moving said first and second door panel means between the open and closed positions, air outlet means extend through said top panel, said air outlet means being adapted to direct air into said closed vestibule adjacent the top of one of said door panel means along at least a major portion of the length of said top panel, air inlet opening means in said top panel for permitting escape of air from said closed vestibule, blower means operatively connected with said air outlet means and said air inlet means for circulating air through said closed vestibule, and heater means associated with said blower means for conditioning air in the closed vestibule to eliminate precipitation resulting from infiltration air and exfiltration air through the closed vestibule.

2. The conditioned air vestibule defined in claim 1 wherein said frame comprises housing means enclosing said blower means and said heater means, and wherein said top panel comprises the bottom wall of said housing means.

3. The conditioned air vestibule defined in claim 2 wherein said air outlet means comprises nozzle means adapted to discharge heated air downward through said closed space in a thin coherent stream along substantially the full width of the door opening.

4. The conditioned air vestibule defined in claim 3 wherein said first door panel means in said closed position has one surface exposed to the cold air in the cold storage room and said second door panel means has one surface exposed to the atmosphere outside the cold storage room, and wherein said nozzle means is adapted to direct heated air downwardly through said closed vestibule along the surface of said first door panel means to warm and prevent the formation of frost on said first door panel means.

5. The conditioned air vestibule defined in claim 4 wherein said air inlet means comprises an elongated opening formed in said top panel in position to permit the escape of air form said closed vestibule into said housing adjacent the top of said second door panel means along substantially the full width of the door opening.

6. The conditioned air vestibule defined in claim 5 wherein the distance between said first door panel means and said second door panel means in the direction of travel through the door opening is no greater than about one fourth the distance between said side panels of said frame.

7. The conditioned air vestibule defined in claim 6 wherein said first and said second door panel means each comprises transparent flexible strip doors.

8. The conditioned air vestibule defined in claim 1 wherein said first door panel means and said second door panel means each comprise a pair of strip doors, one strip door of each said pair of strip doors being mounted adjacent each said side panel of said frame, the strip doors of each pair being disposed in substantially coplanar relationship in the closed position and cooperating to close said portal.

9. The conditioned air vestibule defined in claim 8 wherein the strip doors mounted adjacent each said frame side panel are disposed in overlapping side-by-side relation in said open position.

10. The conditioned air vestibule defined in claim 9 wherein said power means comprises a single power actuator operably connected to each said strip door to simultaneously move all of said strip doors between said open and said closed positions.

11. The conditioned air vestibule defined in claim 10 wherein said frame comprises housing means enclosing said blower means and said heater means, and wherein said top panel comprises the bottom wall of said housing means.

12. The conditioned air vestibule defined in claim 11 wherein said first door panel means in said closed position has one surface exposed to the cold air in the cold storage room and said second door panel means has outside surface exposed to the atmosphere outside the cold storage room, and wherein said nozzle means is adapted to direct heated air downwardly through said closed vestibule along said first door panel means to warm and prevent the formation of frost on said first door panel means.

13. The conditioned air vestibule defined in claim 12 wherein said air inlet means comprises an elongated opening formed in said top panel in position to permit the escape of air from said closed vestibule into said housing adjacent the top of said second door panel means along substantially the full width of the door opening.

14. The conditioned air vestibule defined in claim 13 wherein said mounting means comprises four shafts each journaled in said housing for rotation about a vertical axis with each supporting one of said strip doors for rotation therewith, and wherein said power means comprises means for simultaneously rotating each of said shafts about their respective axes.

15. The conditioned air vestibule defined in claim 14 wherein the distance between said first door panel means and said second door panel means in the direction of travel through the door opening is no greater than about one fourth the distance between said side panels of said frame.

* * * * *